US008733067B2

(12) United States Patent
Draghetti

(10) Patent No.: US 8,733,067 B2
(45) Date of Patent: May 27, 2014

(54) DEVICE FOR PACKAGING A PRODUCT IN A CORRESPONDING CONTAINER

(75) Inventor: Fiorenzo Draghetti, Medicina (IT)

(73) Assignee: GIMA S.p.A., Zola Predosa (Bo) (IT)

( * ) Notice: Subject to any disclaimer, the term of this patent is extended or adjusted under 35 U.S.C. 154(b) by 178 days.

(21) Appl. No.: 13/264,421

(22) PCT Filed: Apr. 13, 2010

(86) PCT No.: PCT/IT2010/000155

§ 371 (c)(1),
(2), (4) Date: Oct. 14, 2011

(87) PCT Pub. No.: WO2010/119472

PCT Pub. Date: Oct. 21, 2010

(65) Prior Publication Data

US 2012/0031051 A1 Feb. 9, 2012

(30) Foreign Application Priority Data

Apr. 17, 2009 (IT) ..... TO2009A0298

(51) Int. Cl.
*B65B 43/10* (2006.01)

(52) U.S. Cl.
USPC ..... 53/383.1; 53/234; 53/148; 53/376.5; 53/377.4; 53/444

(58) Field of Classification Search
USPC ..... 53/228, 234, 383.1, 461, 427, 444, 484, 53/491, 148, 377.4, 376.5; 493/150, 151
See application file for complete search history.

(56) References Cited

U.S. PATENT DOCUMENTS

| | | | | |
|---|---|---|---|---|
| 2,010,196 | A | 8/1935 | Muller | |
| 3,762,132 | A * | 10/1973 | Owen | 53/370.3 |
| 3,899,863 | A * | 8/1975 | Seragnoli et al. | 53/53 |
| 4,503,659 | A * | 3/1985 | Sherman | 53/491 |
| 5,116,322 | A * | 5/1992 | Chromowsky | 53/485 |
| 5,228,266 | A | 7/1993 | Focke | |
| 6,370,846 | B1 * | 4/2002 | Schoch et al. | 53/456 |
| 6,409,646 | B1 | 6/2002 | Focke et al. | |
| 6,463,716 | B1 * | 10/2002 | Focke et al. | 53/370.3 |
| 6,688,077 | B1 * | 2/2004 | Focke et al. | 53/234 |
| 6,789,370 | B2 * | 9/2004 | Spatafora | 53/234 |
| 2003/0093977 | A1 | 5/2003 | Brizzi et al. | |

(Continued)

FOREIGN PATENT DOCUMENTS

| | | | |
|---|---|---|---|
| EP | 0865987 | A1 | 9/1998 |
| EP | 1702848 | A1 | 9/2006 |
| GB | 1425009 | A | 2/1976 |

OTHER PUBLICATIONS

Int'l Search Report issued Oct. 28, 2010 in Int'l Application No. PCT/IT2010/000155; Written Opinion.

*Primary Examiner* — Christopher Harmon
(74) *Attorney, Agent, or Firm* — Panitch Schwarze Belisario & Nadel LLP

(57) ABSTRACT

A device (1) for packaging a product shaped as a set of cigarettes in a corresponding container (A), defining a package for housing the product, comprises means (11) for forming the container (A) and appropriate means (21, 21) to dispense a corresponding adhesive (B1, B2) for joining corresponding panels of the container. Said appropriate means (21) to dispense a corresponding adhesive are provided next to the exit from the forming means (11) and are movable with respect to said container (A).

17 Claims, 6 Drawing Sheets

(56) References Cited

U.S. PATENT DOCUMENTS

Figure 1B:
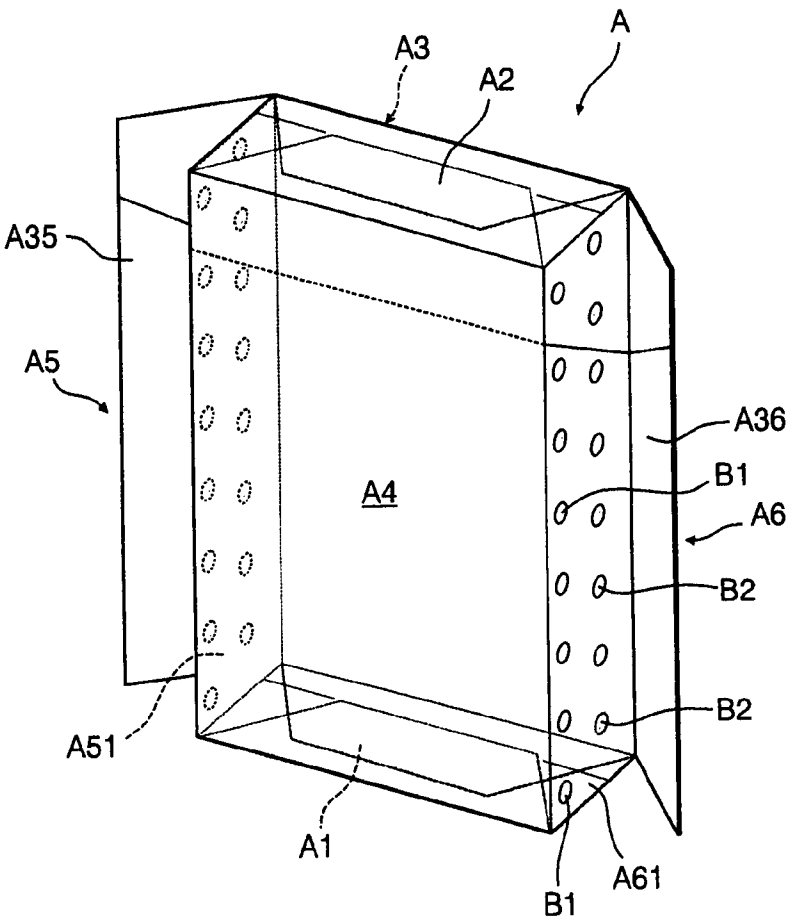

2003/0146068 A1* 8/2003 Polloni et al. ..... 198/461.1
2008/0234120 A1* 9/2008 Fort ..... 493/223
2009/0048084 A1* 2/2009 Morselli et al. ..... 493/150

* cited by examiner

DEVICE FOR PACKAGING A PRODUCT IN A CORRESPONDING CONTAINER

CROSS-REFERENCE TO RELATED APPLICATION

This application is a Section 371 of International Application No. PCT/IT2010/000155, filed Apr. 13, 2010, which was published in the English language on Oct. 21, 2010, under International Publication No. WO 2010/119472 A2, and the disclosure of which is incorporated herein by reference.

The present invention refers to a device for packaging a product in a corresponding container.

In particular, the product is shaped like a group of elongated elements, such as cigarettes, or the like, especially wrapped in a corresponding wrapper, and said container is in turn shaped as a corresponding box-like body, made starting from a corresponding rough-shaped sheet of bendable material, preferably cardboard, and defines a package for housing the product.

Devices are known of for packaging a set of cigarettes in a package that is defined by a box-like body, preferably in cardboard, the devices of which include corresponding wheels, with vertical or horizontal axes, for forming or bending the box-like body around the cigarettes, wrapped in a corresponding wrapper, which are supported on a corresponding seat of the forming wheel.

According to a known type of packaging machine, the gluing or complete closure of the packages is provided on the same forming means or wheels, by providing suitable adhesive dispensing stations on the same wheel. However, these known machines have the drawback of letting the adhesive fall close to said rotating wheels, with the progressive accumulation of said material, which then soils the package being formed. This results in the need to reject a certain number packages soiled by said adhesive and, in any case, the need to carry out cleaning operations, which are laborious and bothersome for personnel and that, on top of this, force undesired machine stoppage.

Cigarette packing equipment is also known in which adhesive of the cold type, or which polymerizes at room temperature, is provided on corresponding panels of the packer, in output from the forming wheel. Nevertheless, in these known machines, means of dispensing the adhesive are used that remain fixed with respect to the container, which moves longitudinally, or radially, on output from said forming wheel, with the container that must therefore be suitably conveyed along an excessively complex path, providing a section for dispensing adhesive on the container in movement, in order to dispense the glue along the entire surface of the container's closing panel, and a section, normally perpendicular, suitable for closing the panel where said glue has been dispensed.

Furthermore, in these known machines in which adhesive that polymerizes at room temperature is used, lengthy or in any case significant polymerization times are necessary in order to adequately provide an effective bonding action of the respective panel, or flap, on the opposite surface of the container, which oblige discharge paths for the container, or packages, from the machine that are quite long and/or are such that a tortuous path is provided for such containers, with consequent structural complications and excessive length of these devices inside the corresponding packing machines. In conclusion, it follows that there is excessive structural complication and length in these known machines.

In the sector, the use of quick-stick hot melt adhesives is also contemplated for joining the corresponding panels of the package. However, this has a drawback in that the packages obtained in this manner do not guarantee bonding solidity and, therefore, long-term preservation of the package's assembly.

According to one advantageous aspect, a device is provided for packaging a product in a corresponding container, said product being in particular shaped as a set of cigarettes, or the like, especially wrapped in a corresponding wrapper, and said container being shaped as a box-like body, made starting from a corresponding rough-shaped sheet made of bendable material, preferably cardboard, and defining a package for housing the product; the device comprises means for forming the container and means able to dispense a corresponding adhesive for joining corresponding panels of the container, characterized in that said means able to dispense a corresponding adhesive are provided next to the exit from the forming means and are mobile with respect to said container.

In this way, it is possible to provide an output path for the products from the respective devices that is simplified with respect to known machines, having a moderate length and achieving easy conveyance of the containers, or packages.

According to a further advantageous aspect, a device is provided for packaging a product in a corresponding container, said product being in particular shaped as a set of cigarettes, or the like, especially wrapped in a corresponding wrapper, and said container being shaped as a box-like body, made starting from a corresponding rough-shaped sheet made of bendable material, preferably cardboard, and defining a package for housing the product; the device comprises means for forming the container and means able to dispense a corresponding adhesive for joining corresponding panels of the container, characterized in that the means able to dispense a corresponding adhesive comprise first and second means for emitting a corresponding jet of adhesive on a corresponding surface of the container.

In particular, it is contemplated that said means able to provide a corresponding adhesive comprise means for dispensing a hot melt adhesive.

In addition, it is contemplated that said means able to provide a corresponding adhesive comprise means for dispensing a cold adhesive.

The arrangement for a quick-stick hot melt adhesive allows devices to be made that have an output stage of reduced length, to the full advantage of the length of the equipment in which the present device is inserted. In addition, the arrangement for a cold adhesive, the adhesive action of which is maintained over time, after the packages have been discharged from the machine, ensures that the packages obtained with the present device are kept in the assembled condition for a long time, which is not guaranteed by hot glue on its own.

The present invention also regards an advantageous process for packaging a product in a corresponding container, in accordance with the enclosed claims.

Figure 1A:
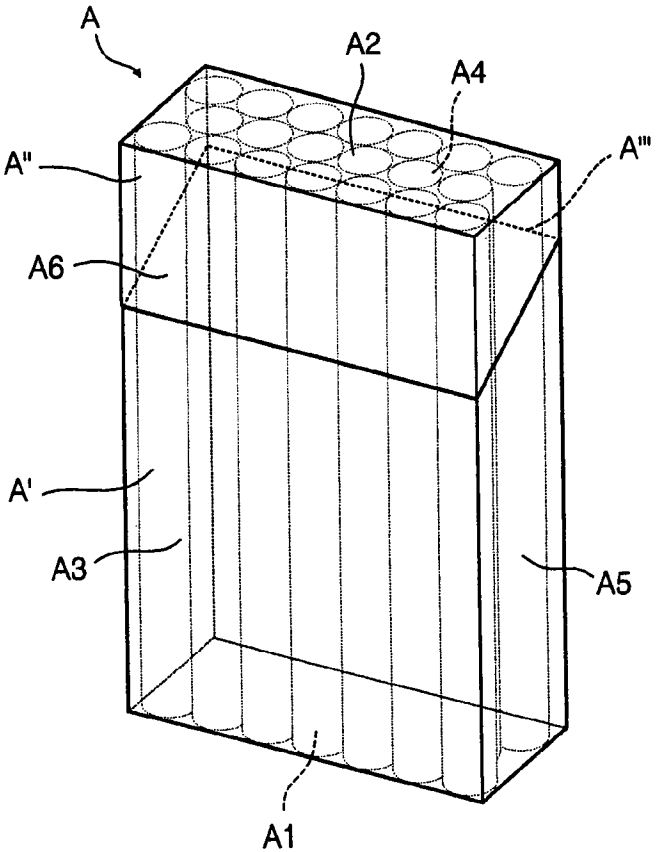
Figure 2:
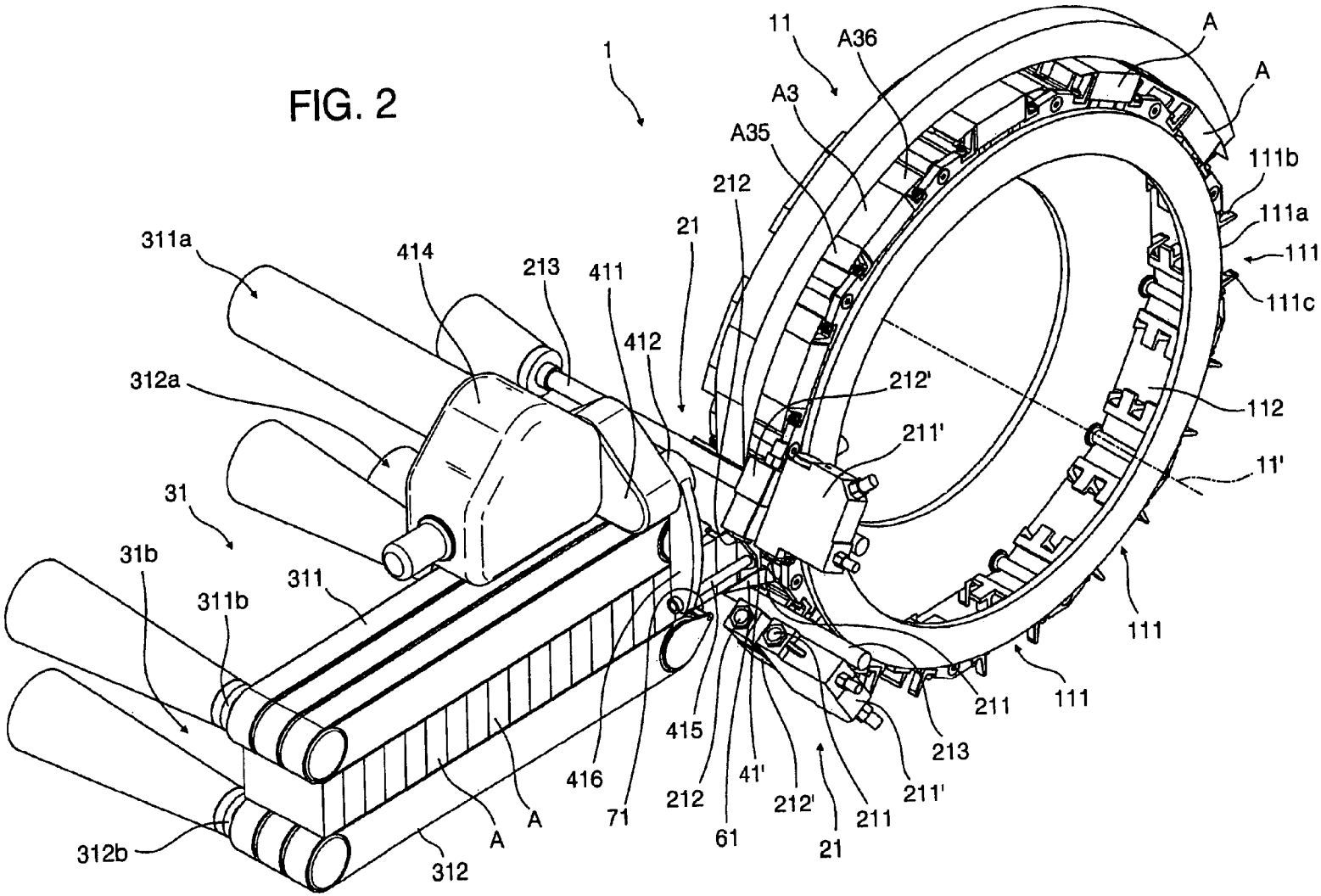
Figure 3:
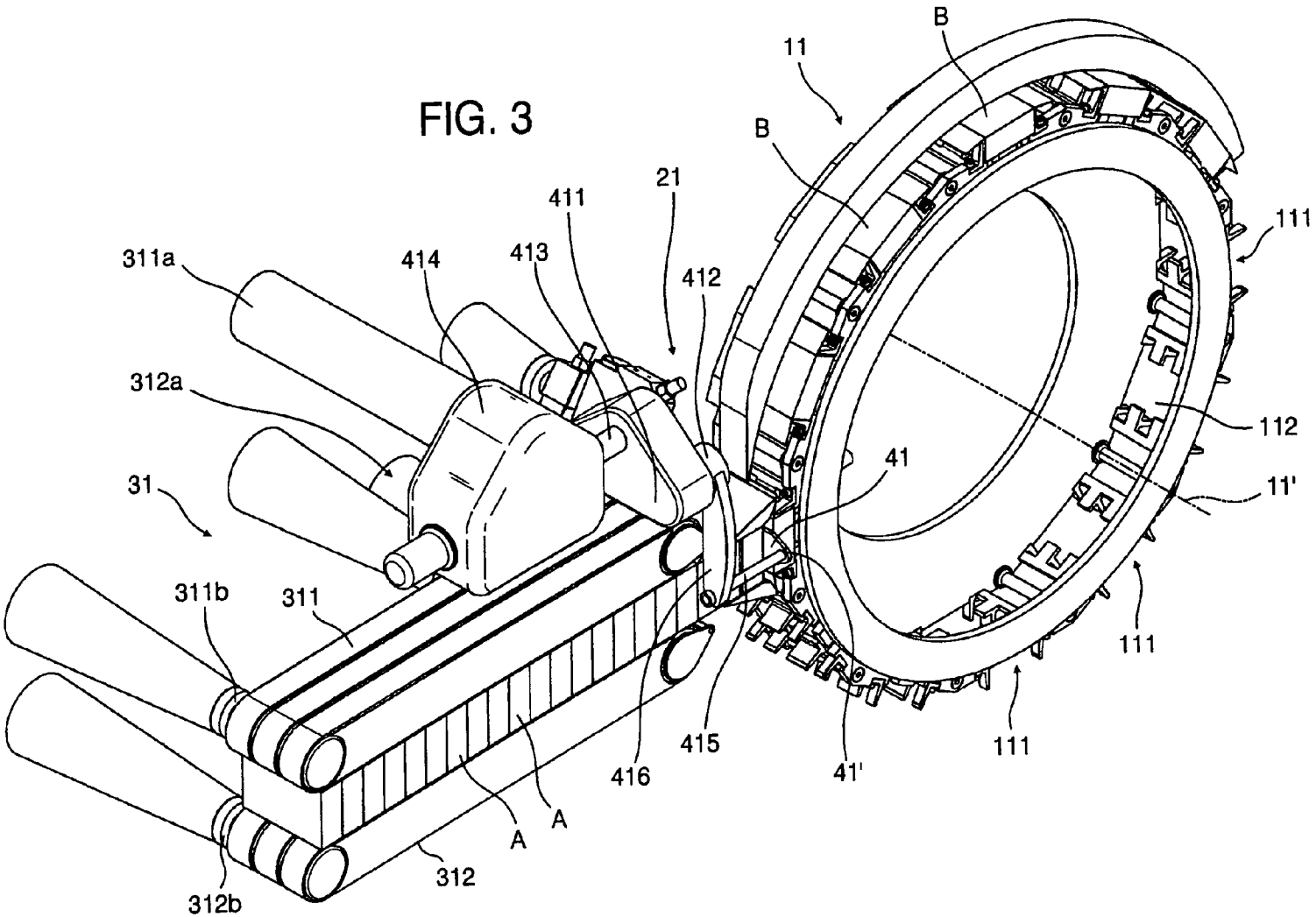
Figure 4:
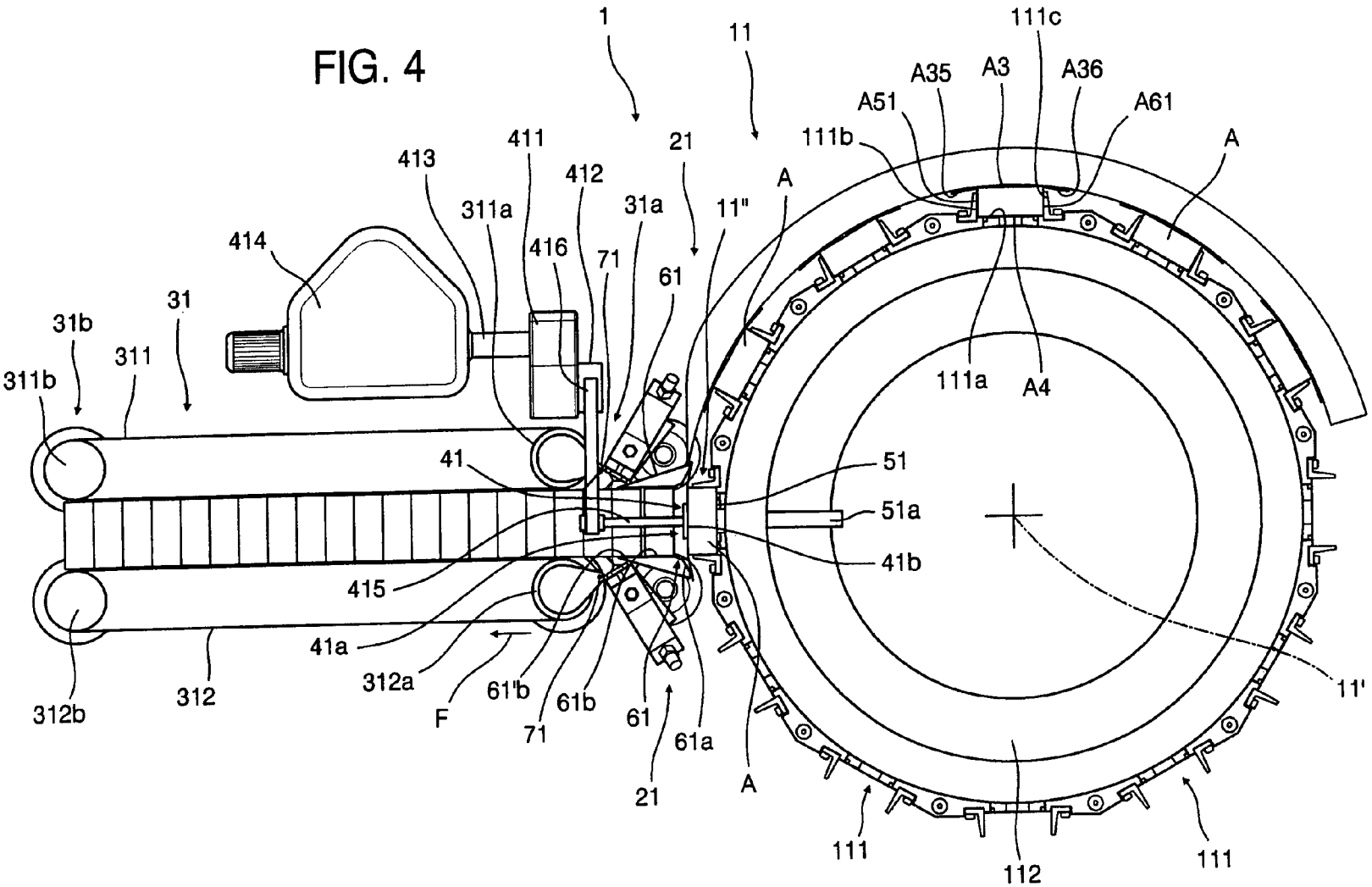
Figure 5:
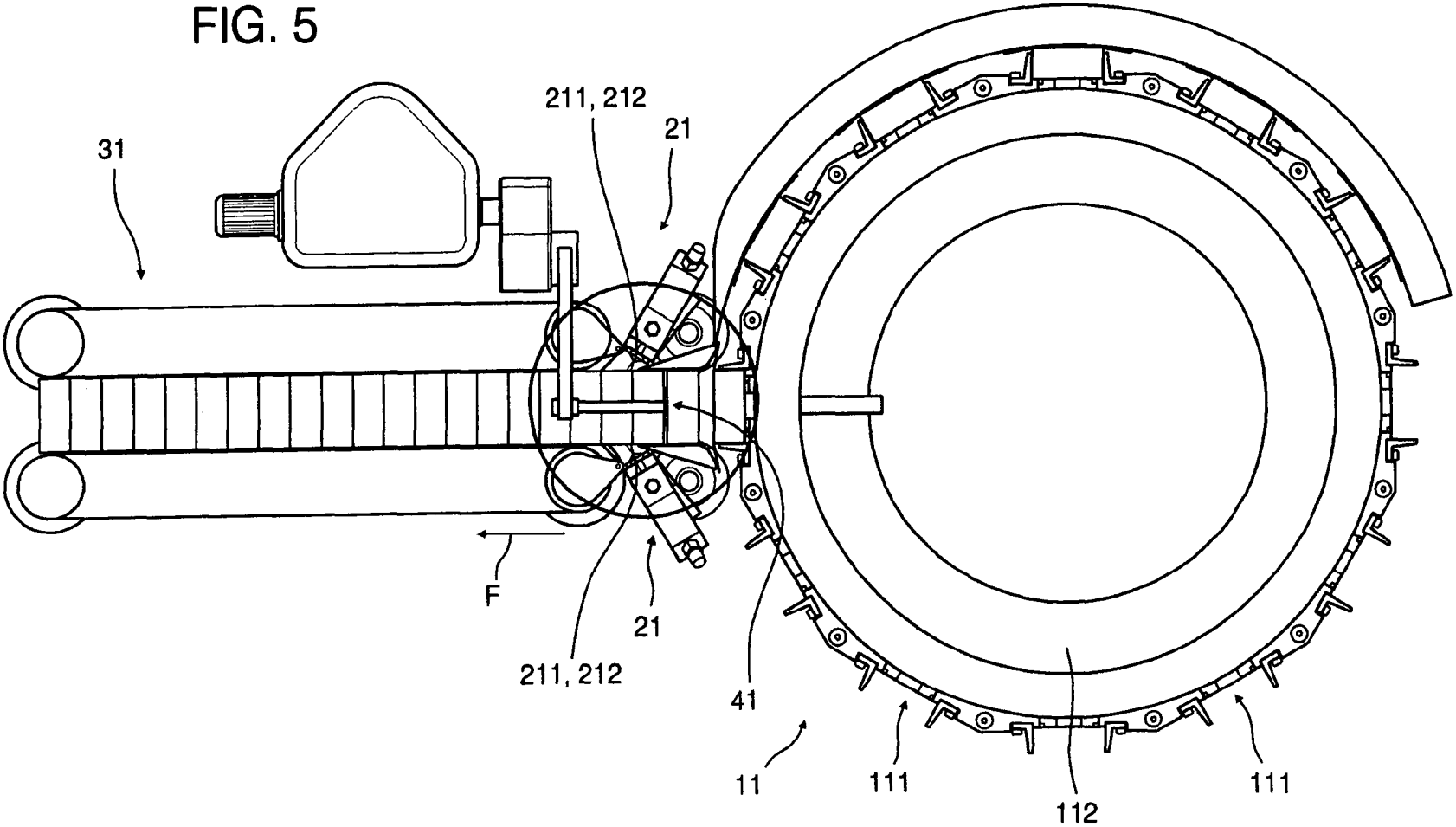
Figure 7:
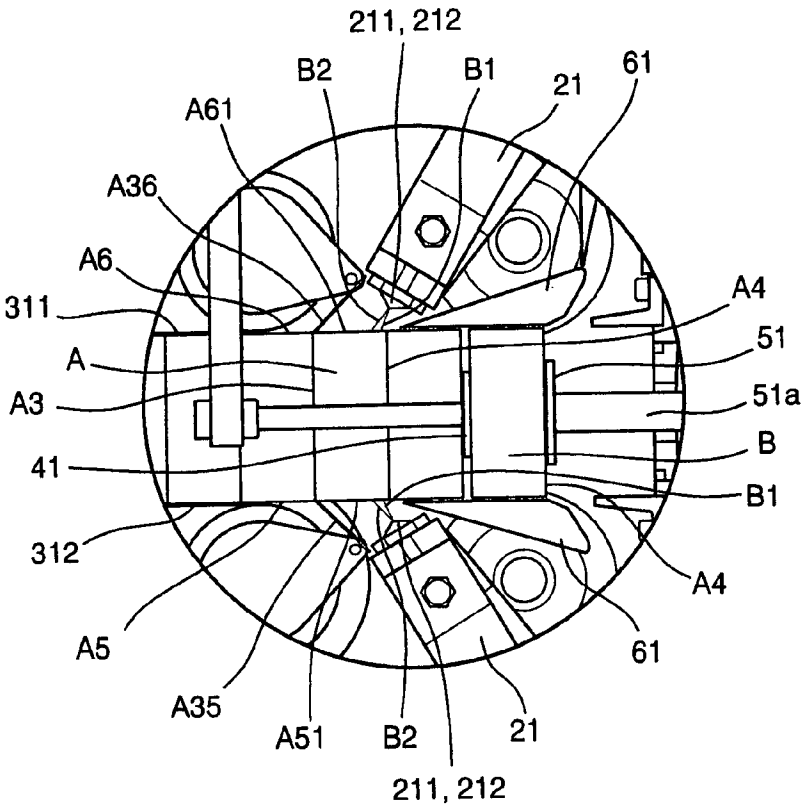
Figure 6:
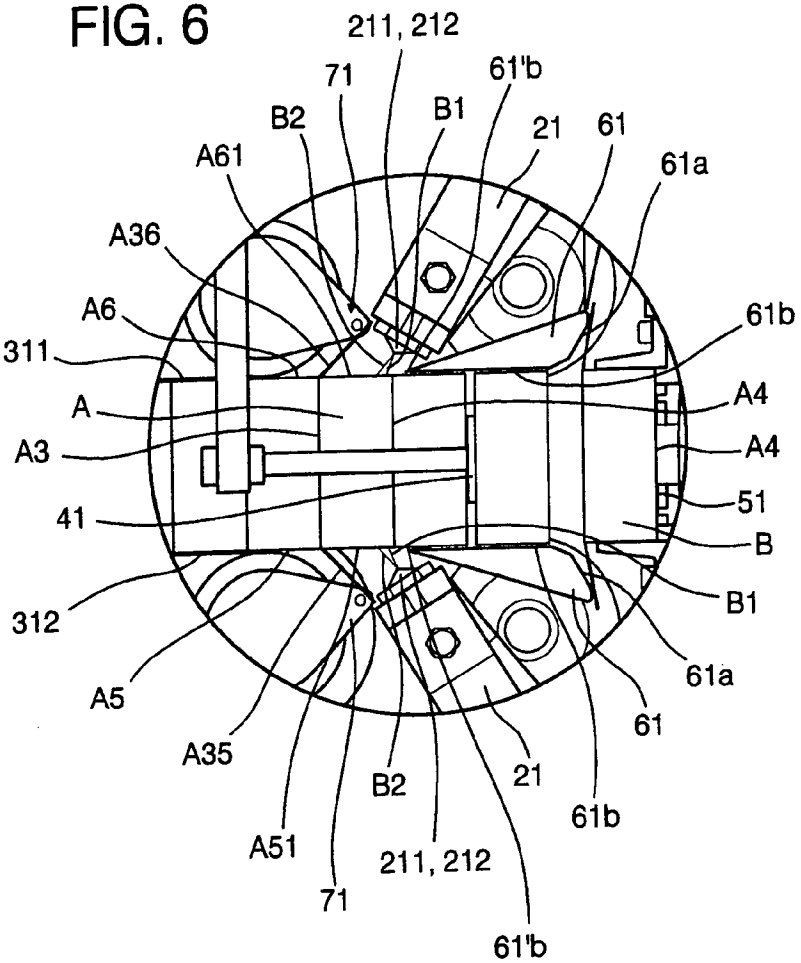

The technical characteristics of the present equipment are clearly identifiable from the below-specified claims, while its advantages shall become clearer in the detailed description that follows, made with reference to the enclosed drawings, which represent a purely illustrative and non-limiting embodiment, where:

FIG. 1A shows a perspective view of a container, or package, made by means of the present preferred embodiment of the packaging device according to the present invention, FIG. 1B shows a view of the container with the flaps, or panels, and closing ends of the box-like body, or package, in the open condition, before closure of the end assembly, FIG. 2 shows a perspective, schematic view of a preferred embodiment of the packaging device according to the present invention, FIG. 3 shows a perspective view, similar to that in FIG. 2, showing a different operating condition of the present device, FIG. 4 shows a schematic front view of the preferred embodiment of the device in a corresponding operating condition, FIG. 5 shows a front view, similar to that in FIG. 4, illustrating the preferred embodiment of the device in a further operating condition, FIG. 6 shows an enlarged view of a detail in FIG. 5 regarding the adhesive dispensing zone, and FIG. 7 shows a detail similar to that in FIG. 6 and regarding a further operating condition of the device.

A preferred embodiment 1 of the device for packaging a product in a corresponding container A is shown in the enclosed FIGS. 2 to 6.

In particular, the product shaped as a set of elongated elements, such as cigarettes, or the like, in particular wrapped in a corresponding wrapper, obtained from an aluminium film or foil.

In turn, said container A is shaped as a box-like body defining a corresponding package that is made starting from a corresponding (rough-shaped) sheet made of a bendable material, preferably cardboard, or a similar bendable material. In particular, the container is of the type having a base body A' for containing the product and that has one end open, which is closed by a corresponding cover A", jointed, or hinged, to said base body via a respective fold line A'".

Said sheet comprises a plurality of panels that can be folded with respect to corresponding fold lines, or pre-creasings, to define corresponding container walls, as respectively shown in FIG. 1A: a perpendicular bottom wall A1, a perpendicular top wall A2, and side walls comprising a wide, transverse front wall A3, wide, transverse rear wall A4 and narrow, or short, longitudinal side walls A5, A6, connecting said first and second transverse walls A3, A4.

In particular, as shown in FIG. 1B, said longitudinal side walls comprise respective first and second panels A35, A36, which extend from a corresponding panel to define the front wall A3 of the package, and which overlap and are joined or glued to a corresponding underlying panel A51, A61, of the same side wall, to define a container end closure in the assembled condition.

As can be deduced with reference to FIGS. 2 and 4 in particular, the present device comprises means 11 for forming the container A that comprise a plurality of seats 111, supported on a corresponding circular frame 112, to define a wheel-like structure revolving around a respective axis 11', which is preferably in the form of a horizontal axis.

In practice, said means for forming the container, in the form of a rotating wheel, comprise a plurality of circumferentially located seats 111 that support the container or package A being shaped or folded around the product or set of cigarettes by corresponding bending means, provided around said wheel and which are not specifically illustrated and described herein.

Said means 11 for forming the box-like body move with intermittent feed motion, having advancement phases that alternate with stop phases, in which the respective operations on the box-like body being shaped are provided, in particular the respective operations of bending the container or package around the product or set of cigarettes, as well as the discharge of the container from the forming means 11.

As shown, the respective seat 111 of said means 11 for forming the container has a perimeter or bottom face 111*a* and opposite, short, radial or side faces 111*b*, 111*c*.

In particular, at least in the final phase of forming, the perimeter or bottom face 111*a* of the seat is, able to respectively engage the transverse face A4 of the container and the opposite short radial or side faces 111*b*, 111*c*, are able to engage the opposite narrow sided, or longitudinal, faces of the container, or rather the internal panels A51, A61 of these, while the upper or external panels A35, A36 of the same narrow longitudinal walls extend open, or circumferentially extended, outside of the side walls 111*b*, 111*c* of the seat.

As can be deduced, especially from FIGS. 2 and 4, said means 11 of forming the box-like body support the latter with the these longitudinal or side walls A5, A6, or the respective panels A51, A61, A35, A36 that, in the final phase of shaping, extend along the respective long side, parallel to the axis of rotation 11' of the forming means, i.e. transversely to the plane of movement or advancement of the very containers being shaped.

Furthermore, at a station or position 11" for discharging the containers or packages from the forming means, the containers A have the respective flaps or panels A35, A36 in the open condition, substantially parallel to the panel A3 defining the above-mentioned transverse front wall of the container, thus remaining in a detached condition from the corresponding panel A51, A61, on which they are then overlaid to define the corresponding longitudinal side wall A5, A6 of the container, thereby making the end closure of the container.

The present device has appropriate means 21, 21 to dispense a corresponding adhesive B1, B2 for joining the corresponding container panels.

It is planned to advantage that said means 21, 21 able to dispense, or deposit, a corresponding adhesive, are provided close to the exit from the forming means 11 and, to advantage, are mobile with respect to the container A, the latter being in the stop condition, in particular, stopped from longitudinal advancement in the direction marked by arrow F in FIG. 4.

In this way, to dispense the adhesive, the need of having to move a container still in the open or disassembled condition, with consequent difficulties and the risk of relative movements occurring between the various parts of the container and the consequent production of packages with an insufficiently accurate shape, is avoided.

In particular, during the dispensing of the adhesive, said container presents at least the respective face on which the adhesive must be dispensed, i.e. the internal panels A51, A61 of the container's longitudinal side walls, which project from the respective seat 111, or rather from the interference with the respective radial walls 111*b*, 111*c* of the latter.

In particular, said means 21, 21 able to dispense a corresponding adhesive act on a container that is positioned outside of the corresponding support seat 111 of the forming means 11.

Said means 21, 21 able to dispense a corresponding adhesive are, to advantage, mobile along a direction transversal to the direction of advancement, marked by said arrow F of said container A exiting the forming means 11, or being fed downstream of said exit.

In this way, it is possible to achieve a moderate length for the container discharge section of this equipment.

In particular, said means 21, 21 able to dispense a corresponding adhesive are transversal to the plane of movement of the containers A on the forming means 11, or parallel to the axis of rotation 11' of the same forming means.

In particular, the means 21, 21 able to dispense a corresponding adhesive move horizontally between a forward position and a rearward position, as can be deduced from FIGS. 2 and 3 and as shall become clearer further on in the present description.

As illustrated, the means for dispensing the adhesive of the present forming device only provide said adhesive between, and to join, first and second external panels A35, A36 and the corresponding internal or underlying panels A51, A61, of corresponding container walls A5, A6 to define a container end closure, able to keep said container in the assembled condition. In practice, adhesive is, to advantage, only applied for said container end closure, and outside of the forming means 11.

In particular, as shown, said means 21, 21 for dispensing the adhesive provide, or dispense, said adhesive between, and to join, first and second external panels A35, A36 and the corresponding panels A51, A61 of opposite container walls A5, A6, in particular defined by the short longitudinal side walls of the same container.

In addition, as shown, said means 21, 21 for dispensing the adhesive provide, or dispense, said adhesive on panels A51, A61, upon which corresponding panels A35, A36 defining container walls A5, A7 are overlaid and joined, these panels extending, with the respective short side, parallel to the container's direction of advancement F.

To advantage, said means able to dispense a corresponding adhesive are in the form of first and second adhesive dispenser units 21, 21, which are able to emit at least one corresponding jet of adhesive, along substantially opposite directions, and which are arranged in vertical alignment and set apart from each other, being positioned at the sides of the advancement path of the respective containers, so as to dispense the adhesive on the panels, or faces, which extend horizontally and are at mutually different height levels.

In practice, said first and second adhesive dispenser units 21, 21 are arranged close to opposite longitudinal container sides A5, A6.

As shown, said means 21, 21 able to dispense a corresponding adhesive are linearly mobile and parallel to a corresponding face, or wall, of the container, between an extended position, at the start of adhesive dispensing, and a retracted position at the end of adhesive dispensing, after which they return to said extended position.

Said means 21, 21 for dispensing adhesive comprise, to advantage, means 211 of dispensing a first hot melt adhesive, that is which polymerizes or adheres at high temperature, and means 212 of dispensing a second cold adhesive, that is which polymerizes or adheres at low temperature or room temperature.

In practice, the means able to dispense a corresponding adhesive, comprise, on each unit 21, 21, respective first and second means, or nozzles, 211, 212, for emitting a corresponding jet of adhesive B1, B2.

As shown, in each unit 21, 21, said first and second means 211, 212 for emitting a corresponding jet of adhesive are joined together or at least supported on a mobile common support member.

As can be deduced from FIG. 6 in particular, said first and second means 211, 212 for emitting a corresponding jet of adhesive are able to direct the respective jets of adhesive B1, B2, along a respective direction, so as to make an angle with the other nozzle's direction of emission.

As can be deduced from FIG. 1B in particular, said first and second means 211, 212 for emitting a corresponding jet of adhesive are able to dispense the adhesive, in the form of respective glue dots, along respective strips, or lines, which are mutually parallel, depositing the adhesive on the respective external face of the internal panel A51, A61, defining the lateral side wall of the container, as can be easily deduced from FIG. 1B.

In addition, said first and second means 211, 212 for emitting a corresponding jet of adhesive are supported in alignment or substantially in alignment with each other, according to the dispensing direction, as they are supported on a common support shaft 213 moving transversely to the container handling plane, or parallel to the axis of rotation 11' of the means for forming the container. Furthermore, in particular the nozzles 211, 212, for emitting a corresponding jet of adhesive, are supported on a corresponding block 211', 212', carried on a common support shaft 213, and preferably connected by corresponding pipes (not shown in the enclosed figures) to corresponding tanks respectively containing a hot melt adhesive and a cold adhesive.

In addition, means are also provided for stabilising the adhesion, or setting, of said adhesive, which allow the adhesive to reach a suitable condition to bond the respective external panel onto the corresponding internal panel to which it is associated.

Said means of stabilising the bonding action provided by the adhesive are, in particular, in the form of means 31 for conveying the container downstream of the exit from the forming means 11.

Said conveying means 31 also define means of discharging the containers from the equipment and they extend longitudinally, starting from said exit of forming means, or radially with respect to the centre of rotation of said forming means.

As shown, said conveying and discharging means have an entrance end 31*a* for containers, or packages, B, and an exit end 31*b* for said containers, or packages, B.

In particular, said container entrance end 31*a* is frontally, or radially, arranged in front of the exit for the same containers from the forming means 11, in front of the respective seat 111 of the forming means in the container expulsion position.

As shown, said means 21, 21 able to dispense a corresponding adhesive are arranged between the forming means 11 and the means 31 of conveying and discharging the containers B.

As shown, said means for conveying and discharging articles are in the form of first and second rotating means 311, 312 engaging opposite sides of the container and are, in particular, in the form of respective flexible elements, in particular in the form of a first and a second belt, or tape, 311, 312, which are perpendicularly set apart and can turn on corresponding rollers 311*a*, 311*b* and 312*a*, 312*b*, which are longitudinally set apart from each other.

As shown, said containers B are grasped between said belts 311, 312, which make contact with them and press the respective flaps, or panels, A35, A36 against the underlying panels A51, A61 of the container's side walls A5, A6.

In said conveying means 31, the containers B are arranged side by side, with the transverse faces A3, A4 of the respective container in reciprocal contact with the transverse walls of the container that precedes and the container that follows, as can be easily deduced from FIG. 6.

As shown, said means 21, 21 able to dispense a corresponding adhesive, are mobile along a along a direction transversal to the longitudinal, or linear, direction F for advancing the containers in the stabilising or conveying means 31 and in the means of transfer (better described further on) from the forming means 11 to the stabilising or conveying means.

In particular, as shown, said shafts 213, 213 for moving and supporting the means for dispensing adhesives and said support shafts of the corresponding rotating roller guides of the respective belts 311, 312 for transporting or conveying the containers, extend on the same side as said conveying means.

In particular, as shown, said means 21, 21 for dispensing the adhesive are longitudinally aligned with the conveying means 31.

Means 51 are also provided for expelling the containers from said forming means 11.

Said expulsion means 51 are in the form of a corresponding ejector, which moves between a forward expulsion position and a rearward position, shown in FIG. 6, of engagement with a corresponding container B to be discharged from the forming means 11, and a forward expulsion position of the container, shown in FIG. 7, the ejector 51 of which has a corresponding blade for engaging a rear transverse face A4 of the container, which is supported by a corresponding longitudinal shaft, or stem, 51*a* and is provided next to the exit, or expulsion, station of containers from the forming means 11.

Said ejector 51 moves to expel the respective container when the forming means are stationary, starting from a radially retracted position, in which it does not interfere with the rotation of said forming means 11.

To advantage, means are provided for transferring the container B from the forming means 11 to the conveying means 31.

To advantage, means 41, 51 of supplying the container exiting the forming means and means 41 of downstream advancement of the same container, in particular defining said transfer means, are also provided.

Said transfer means also comprise means 61, 61 supporting the containers that are located between the forming means 11 and the conveying means 31.

Said intermediate support means 61, 61 retain the respective container bilaterally, engaging opposite walls of the same container, as shall be better shown further on, and, moreover, define means of bending the corresponding container panels.

In particular, said transfer means comprise said means for expelling the container from the respective seat 111, and means 41 acting on container B to oppose the pushing action provided by said means 51 of container expulsion.

In practice, said exit supply means 41, 51 of the transfer means comprise an opposing pusher 41, acting on the container B, in particular on the face opposite the one engaged by the expelling ejector 51.

In practice, as shown, said opposing pusher 41 and said expelling ejector 51 of the transfer means move in unison, longitudinally or radially with respect to the forming wheel 11, holding a corresponding container between them, engaging opposite transverse faces A3, A4 of the container, as can be easily deduced from FIG. 6.

In greater detail, said transfer means comprise means 41 for advancing the containers B towards the conveying means, which are defined by just the blade 41 and the means of supplying the containers exiting the forming means 11, which are defined by said expulsion means 51 and by the opposing means 41.

Said means for advancing the containers B towards the conveying means 31 are therefore in the form of means for engaging and pushing a respective container B and are able to engage a rear face of the respective container B.

Said means 41 for advancing the containers are, in particular, able to advance a plurality of mutually aligned containers having their respective transverse faces facing and in contact with each other.

In practice, a plurality of containers are pushed by means 41 towards the downstream conveying means 31, with the containers in a condition of reciprocal contact, simply thanks to the engagement and pushing of a container positioned behind the plurality of containers. Thus, a plurality of containers located upstream of said conveying means 31 advance simultaneously.

In practice, said advancement means 41 act on a corresponding container downstream of that moved between said expelling ejector 51 of the forming means and the opposing pusher 41, to provide a corresponding action of advancement towards the discharge conveyor 31, i.e. towards the entrance end of said conveyor 31.

In practice, said advancement means 41 act on a same container subsequent to the advancement provided by said expelling ejector 51 of the forming means, cooperating with the opposing pusher 41.

Said advancement means are therefore in the form of a corresponding pusher able to engage a rear face of the respective container that is, to advantage according to the present preferred embodiment, defined by said opposing pusher 41 of the means of supply on exit from the forming wheel.

Said pusher 41 is mobile between a longitudinally rearward position for engaging a container B being expelled from the respective seat 111 of the forming means, shown in FIG. 4, and a longitudinally advanced position for pushing a downstream container towards the conveying means 31, shown in FIG. 5.

Said pusher 41 is also transversely mobile, starting from a longitudinally advanced position, in which it projects from the interference with said containers, and can therefore move longitudinally backwards until it reaches a longitudinally rearward position, and then transversely until it reaches a position that is longitudinally aligned with the containers, where it able to engage a corresponding container being expelled from the respective forming means 11.

In practice, said pusher 41 is longitudinally mobile between a rearward position and a forward position, and transversely mobile between a position of longitudinal alignment with the containers and a disengaged position with respect to the containers, from which a longitudinal backward return to the starting rearward position is possible and then, always transversely, to a position of longitudinal alignment and engagement with the containers.

As shown, said pusher 41 is supported by a respective block 411, from which a longitudinal shaft 412 extends longitudinally, turning between an angular engagement position of the pusher 41 with a respective container and an angular disengagement position of the same pusher 41 with a respective container B and outside of the longitudinal alignment with said containers.

Said pusher 41 is also supported by a respective shaft 413, longitudinally mobile and extending from a main block 414. As shown in FIG. 4, said shaft 413 supports said support block 411 of the rotating shaft 412.

In practice, said pusher 41 is supported by a shaft 413, which is longitudinally mobile and extends from a main support block 414, housing corresponding longitudinal kinematic drive mechanisms of said shaft 413.

Said shaft 413 also supports said transverse block 411, which internally houses the rotational kinematic mechanisms of shaft 412, which longitudinally extends to said block 411 and is able to turn in order to move said pusher 41 transversely.

Said pusher 41 is in the form of a blade with a general quadrangular shape having a front face 41*a* and a rear face 41*b*, making contact with the facing containers respectively upstream and downstream of the blade, along the longitudinal direction of movement of said containers.

Said pusher, or blade, 41 is supported by a longitudinal stem 415 that extends alongside said containers when the containers advance, which is in turn connected to a transversal, or vertical, rod 416, which extends sideways to the advancing containers and is integral with said rotating shaft 412.

Said blade 41 has a respective transversely extending portion 41' that projects sideways from the containers in the operating condition where the blade is longitudinally aligned with said containers. The projecting portion 41' is directly integral with said longitudinal stem 415.

As can be deduced from FIG. 4, the blade 41 acts as an opposing pusher when the respective rear face 41*b* of said blade is engaged with a corresponding container B in expulsion from said forming means 11, whilst in the condition in FIG. 6, in which said pusher 41 acts as forward pusher on a plurality of containers towards the conveying means 31, the front face 41*a* of said blade is shown in contact with the rear face of the last container in the line of containers previously expelled from the forming means 11.

Means 61 are also provided for bending the corresponding panel A35, A36 over the opposite panel A51, A61 of the corresponding container wall, such bending means 61 being arranged downstream of the exit from the forming means 11, i.e. downstream of the respective seat 111 from which the container is expelled from the forming means 11.

As explained, said bending means 61 define intermediate support means for the containers during transfer and passage to the conveying means 31.

Said bending or support means are, in particular, in the form of first and a second blocks 61, 61 for engaging opposite panels of the container, which are vertically aligned and set apart to allow passage of the containers, by friction or sliding, between these same blocks 61, 61.

The blocks 61, 61 comprise a respective transverse surface that faces the forming means, which is able to engage a corresponding panel, or flap, A35, A36 in the container's stretched out condition, and a corresponding longitudinal face facing the other block 61 and that is able to engage, by sliding, the corresponding container wall and keep it in the closed condition.

Said transversal and longitudinal faces of the panel bending block are respectively indicated by reference numerals 61*a*, 61*b*.

In practice, longitudinal face 61*b* abuts and presses the corresponding panel A35, A36 onto the internal panel A51, A61.

As shown, said transverse surface 61*a* extends at an angle with respect to the longitudinal direction of advancement and is connected to said longitudinal surface 61*b* via a tapered surface, so as to provide progressive bending of the respective flap or panel A35, A36 of the container.

To advantage, as shown, said first and second bending blocks, engage opposite longitudinal walls A5, A6 of the container, define means of bilateral restraint of the respective containers in a perpendicular or vertical direction and, in particular, are able to keep a respective container B blocked during the backward return phase of the pusher 41 towards the expulsion means 51, or towards the forming wheel 11.

In particular, the lower block 61 defines lower means of support for the containers near to the transfer means 41, while the upper block 61 defines perpendicular means of restraint for the same containers.

Said bending or support means 61, 61 are longitudinally aligned with the conveying means 31 and have a tail end 61'*b*, longitudinally opposite to their head end 61*a*, which is longitudinally set apart from the downstream conveying means 31, or rather from the entrance end 31*a* of the conveying means 31.

As shown, said means 21 for dispensing the adhesive are provided between said bending means 61 and the conveying means 31.

Advantageous means 71 are also provided for opposing the elastic opening of the container's corresponding end closing panel.

Said means 71 for opposing the elastic opening of the container's corresponding panel A35, A36, comprise a respective fixed surface for engaging the external face of said panel, which is arranged angularly apart from the corresponding container wall A51, A61 to which said panel A36, A35 is associated, in particular, with an angle that is less than 90°, when said container A is placed in the corresponding position for dispensing the adhesive.

In particular, as shown, a first and a second fixed engagement surface 71, 71 are provided for the external face of the corresponding panel of opposite container panels, which are arranged in vertical alignment and set apart from each other.

As shown, said means 71 for opposing the elastic opening of the corresponding panel A35, A36 of container A are longitudinally aligned with the bending means 61 and the conveying means 31, being longitudinally set apart from said bending means 61, at a distance such as to allow the positioning of said means 21 for dispensing adhesive between this surface, or transverse bar, for limiting the angular opening of the corresponding panel and a corresponding front, or downstream, surface 61'*b*, of the bending blocks 61.

Said means 71, 71 for opposing the elastic opening of the corresponding container panel are next to the conveying means, in particular, fixed to or integral with a respective entrance end of the conveying means 31 and are in the form of a corresponding projection, extending at the back of said conveying means 31, supporting a corresponding transverse bar.

As shown, in the adhesive-dispensing condition, the respective container is supported between and by a downstream container and an upstream container, where the downstream container is held and supported by the conveying means 31, while the upstream container is supported and held by the support and bending means 61.

In addition, means are also provided for the final bending of the corresponding closing panel on the opposite container panel or surface, which are constituted or defined, to advantage, by a corresponding end of the conveying means, in particular of the respective belt 311, 312 of the same conveying means 31.

In practice, with the advancement of said containers, having the adhesive dispensed on the opposite faces of the container, the same containers enter the conveying means 31 with one of their upstream ends and, by engaging the same belts 311, 312, which make contact with the external face of the open panels A35, A36, the closure, with compression, of said panels A35, A36 onto the respective underlying panel A51, A61 of the corresponding longitudinal side wall of the container A35, A36 is obtained.

In practice, the opposing belts 311, 312 define the corresponding container panels in the opposite end bending means.

According to the present embodiment, during the advancement downstream of the forming means, on both the transfer means and the conveying means, said container is advanced with the respective wide front and rear transverse faces A3, A4 perpendicular to the direction of advancement F and with the short opposite side faces A5, A6 showing the respective short side, which is parallel to the direction of advancement.

According to the present embodiment, during the dispensing of the adhesive, said container is on the means of transfer between the seat and the conveying and adhesive stabilization means.

According to the present embodiment, during the dispensing of the adhesive, said container is held by bilateral engagement of opposite faces of the container, in particular on the transverse faces of the same container.

A process is embodied with the present device for packaging a product in a corresponding container A, in which said product is in particular shaped as a set of cigarettes, or the like, in particular wrapped in a corresponding wrapper, and said container A is shaped as a box-like body, made starting from a corresponding rough-shaped sheet made of bendable material, preferably cardboard, and defines a package for housing the product. The process provides for forming the container around the product and dispensing a corresponding adhesive B1, B2 for joining corresponding panels of the container, and is characterized in that the adhesive is only dispensed on first and a second panels A35, A36 suitable for being overlapped and joined to at least one corresponding underlying panel A51, A61, and which are able to define a container end closure in the assembled condition.

According to the process, the corresponding panel defining the end closure is overlapped on the underlying panel and then detached from it, the adhesive dispensed and then the corresponding panel placed back in contact with the underlying panel.

According to the process, the panel is allowed to detach itself from the underlying panel under the elastic return effect.

A process is also embodied with the present device for packaging a product in a corresponding container A, in which said product is in particular shaped as a set of cigarettes, or the like, in particular wrapped in a corresponding wrapper, and said container A is shaped as a box-like body, made starting from a corresponding rough-shaped sheet made of bendable material, preferably cardboard, and defines a package for housing the product. The process provides for forming the container around the product and dispensing a corresponding adhesive B1, B2 for joining corresponding panels of the container, and is characterized in that, to make a panel A35, A36 of the container adhere to a corresponding underlying panel A51, A61, a hot melt adhesive and a cold adhesive are used, i.e. a hot melt adhesive and a cold adhesive are applied on a common surface of the container exiting the forming means.

According to the process, the container downstream of the exit from the forming means is moved linearly and advanced by steps, or with an alternating motion having advancement phases alternated with advancement stop phases.

In practice, in a first phase, the container is moved out of the respective seat 111 of the forming means 11 thanks to the exit supply means 41, 51.

Then, the means 41, 51 for supplying the container exiting from the forming means insert the container, by friction, between the intermediate support means 61, 61 that bilaterally engage the container, opportunely retaining it.

Subsequently, the means 41 of advancement downstream of the transfer means make the container advance, by friction, on the intermediate support means until the container sticks out from them, with an engagement and retaining action on a downstream container, which is in turn in the adhesive-dispensing condition.

In a successive phase, the means 41 of advancement downstream of the transfer means make the container advance to the position for receiving the adhesive and, in a successive phase, make the same container advance to the conveying means, passing it to them in a position such that it sticks out at the back from the same conveying means, to engage and retain a previous, or upstream, container, which in turn is in an adhesive-receiving condition.

Afterwards, the container is made to advance in steps, or with alternating motion, by the conveying means 31 until the completion of the adhesive's stabilisation or bonding action.

The thus conceived invention is susceptible to evident industrial application. It can also be subjected to numerous modifications and variants, all falling within the scope of the inventive concept; furthermore, all details can be substituted by technically equivalent elements.

The invention claimed is:

1. A device (1) for packaging a product in a corresponding container (A), said product being shaped as a set of cigarettes and wound into a corresponding envelope, said container (A) being shaped as a box and made from a corresponding sheet of bendable material, said container defining a package for housing the product, the device comprising:

means (11) for forming the container (A), wherein said means (11) for forming the container (A) have a respective station (11") for exiting the container (A), in which a respective terminal closing panel (A35, A36) of the container is in an elastic open, or detached, condition from an underlying panel (A51, A61) of a side longitudinal container wall (A5, A6);

means (21) configured to dispense a corresponding adhesive (B1, B2) for joining corresponding panels of the container, provided next to an exit of the forming means (11) in correspondence with the station (11") for exiting the container (A) and movable with respect to said container (A), said means (21) for dispensing the adhesive supplying said adhesive only between a respective first and second terminal closing panel (A35, A36), in said open, or detached condition, and the corresponding underlying panel (A51, A61) of the side longitudinal walls (A5, A6) of the container (A), defining a terminal container closure, suitable to keep the container (A) in an assembled condition;

conveying means (31) configured to convey containers (A) downstream of the exit from the forming means (11); and transfer means (41, 51, 61) configured to transfer respective containers (A) exiting from the forming means (11) to the conveying means (31), and configured to maintain the containers A in a stopped condition during dispensing of the adhesive by the means (21) configured to dispense a corresponding adhesive (B1, B2).

2. The device according to claim 1, wherein said means (21) configured to dispense a corresponding adhesive are movable along a transverse direction to an advancement direction of said container (A) going out of the forming means (11).

3. The device according to claim 1, wherein said means (21) configured to dispense a corresponding adhesive a comprise first and a second assemblies (211, 212) for dispensing the adhesive on opposite container faces.

4. The device according to claim 1, wherein the means (21) configured to dispense a corresponding adhesive comprise first and second means (211, 212) for emitting a corresponding jet of adhesive (B1, B2) on a corresponding surface (A51, A61) of the container.

5. The device according to claim 4, wherein said first and second means (211, 212) for emitting a corresponding jet of adhesive are adapted to dispense the respective adhesive along respective parallel bands.

6. The device according to claim 5, wherein said first and second means (211, 212) for emitting a corresponding jet of adhesive are supported by a common mobile member (213).

7. The device according to claim 1, further comprising means for stabilizing the adhesion provided by the adhesive or for discharging the containers downstream of the exit from the forming means (11), and wherein said means (31) configured to convey the containers downstream of the exit from the forming means (11) include said means for stabilizing the adhesion or said means for discharging the containers (B).

8. The device according to claim 7, wherein the means (21) configured to dispense a corresponding adhesive are arranged between the forming means (11) and the means (31) for conveying said containers (B).

9. The device according to claim 7, wherein said means (31) configured to convey the containers comprise rotating means (311, 312) engaging opposite sides (A5, A6) of the container.

10. The device according to claim 7, wherein said (21) means configured to dispense a corresponding adhesive are movable along a transverse direction to the advancement direction of the containers by the conveying means (31).

11. The device according to claim 1, wherein said transfer means (41, 51, 61) configured to transfer containers are also configured to supply the respective containers exiting from the forming means (11) and advance the same respective containers downstream, said transfer means further comprising means (61, 61) for supporting the containers that are arranged intermediate between the forming means (11) and the conveying means (31), said intermediate supporting means (61, 61) retaining the respective container bilaterally, engaging opposite walls of the same container.

12. The device according to claim 11, wherein said transfer means comprise an ejector (51) for expelling from the forming means (11), which engages a rear face of the container (B), and an abutment pushing device operating on the container (B) on an opposite face to the expelling ejector (51) face and that moves in unison with said ejector (51), bilaterally keeping the corresponding container (B), wherein said means (41) for advancing the containers are engaging and pushing means of a respective container (B), configured to advance a plurality of containers.

13. The device according to claim 11, wherein means (61) are provided for bending the corresponding panel downstream of the exit from the forming means (11), or for intermediately supporting the container, and comprise a first and a second small blocks (61, 61) for engaging opposite walls (A5, A6) of the container.

14. The device according to claim 11, wherein said means (21) for dispensing the adhesive are provided between the bending, or intermediately supporting means (61) and the conveying means (31).

15. The device according to claim 7, wherein means (71) are provided for contrasting an elastic opening of the corresponding container panel, wherein said means (71) are adjacent to the conveying means (31).

16. The device according to claim 12, wherein, under an adhesive-dispensing condition, the respective container (B) is supported by, and between a downstream container and an upstream container or by a downstream container on the conveying means (31) or by an upstream container arranged on the intermediate supporting means (61).

17. The device according to claim 9, wherein said rotating means (311, 312) are configured to grasp said containers, to make contact with them and press the respective panels (A35, A36) against the panels (A51, A61) below.

* * * * *